US009206677B2

(12) United States Patent
Song et al.

(10) Patent No.: US 9,206,677 B2
(45) Date of Patent: Dec. 8, 2015

(54) ADJUSTABLE VANE DIFFUSER INSERT FOR ELECTRICAL SUBMERSIBLE PUMP

(75) Inventors: Baojun Song, Tulsa, OK (US); David Chilcoat, Jenks, OK (US)

(73) Assignee: Baker Hughes Incorporated, Houston, TX (US)

( * ) Notice: Subject to any disclaimer, the term of this patent is extended or adjusted under 35 U.S.C. 154(b) by 653 days.

(21) Appl. No.: 13/586,417

(22) Filed: Aug. 15, 2012

(65) Prior Publication Data

US 2013/0051977 A1 Feb. 28, 2013

Related U.S. Application Data

(60) Provisional application No. 61/527,830, filed on Aug. 26, 2011.

(51) Int. Cl.

| | |
|---|---|
| ***F04D 1/06*** | (2006.01) |
| ***E21B 43/12*** | (2006.01) |
| ***F04D 29/46*** | (2006.01) |
| ***F04D 29/62*** | (2006.01) |

(52) U.S. Cl.

CPC ..... *E21B 43/128* (2013.01); *F04D 1/063* (2013.01); *F04D 29/466* (2013.01); *F04D 29/628* (2013.01)

(58) Field of Classification Search

CPC . F04D 27/002; F04D 27/0246; F04D 29/466; F04D 29/46; F04D 29/566; F04D 29/56; F04D 29/563; F04D 15/0038

USPC ..... 415/161, 903, 199.3, 199.2, 199.1; 417/423.3

See application file for complete search history.

(56) References Cited

U.S. PATENT DOCUMENTS

| | | | | |
|---|---|---|---|---|
| 2,300,766 | A * | 11/1942 | Baumann | 415/149.1 |
| 4,932,835 | A | 6/1990 | Sorokes | |
| 2008/0199300 | A1 | 8/2008 | Eslinger | |
| 2010/0080694 | A1 | 4/2010 | Chapman et al. | |

FOREIGN PATENT DOCUMENTS

| | | | |
|---|---|---|---|
| JP | 58193000 | A * | 11/1983 |
| WO | WO03019013 | A1 | 3/2003 |

* cited by examiner

*Primary Examiner* — Richard Edgar
(74) *Attorney, Agent, or Firm* — Bracewell & Giuliani LLP

(57) ABSTRACT

A pump having an insert between an impeller and diffuser, where the insert includes an annulus that is in communication with fluid flow passages in the impeller and diffuser. The passages and annulus define a fluid flow path through the pump. Vanes are provided in the annulus that can pivot and vary the cross sectional area of the fluid flow path. Regulating the fluid flow path area alters the flow rate where the pump operates at its maximum efficiency. Thus by monitoring flow through the pump, the vanes can be adjusted so the flow rate of maximum efficiency corresponds to the actual flow rate.

17 Claims, 5 Drawing Sheets

ADJUSTABLE VANE DIFFUSER INSERT FOR ELECTRICAL SUBMERSIBLE PUMP

RELATED APPLICATIONS

This application claims priority to and the benefit of co-pending U.S. Provisional Application Ser. No. 61/527,830, filed Aug. 26, 2011, the full disclosure of which is hereby incorporated by reference herein.

BACKGROUND

1. Field of Invention

The present disclosure involves a device and method for dynamically regulating operating characteristics of a pump and increasing a range of optimal operating parameters. More specifically, the present disclosure relates to adjustable vanes upstream of a pump diffuser that respond to varying flow conditions allowing the pump to optimally operate at the varying conditions.

2. Description of Prior Art

Submersible pumping systems are often used in hydrocarbon producing wells for pumping fluids from within the wellbore to the surface. These fluids are generally liquids and Include produced liquid hydrocarbon as well as water. One type of system used employs an electrical submersible pump (ESP). ESPs are typically disposed at the end of a length of production tubing and have an electrically powered motor. Often, electrical power may be supplied to the pump motor via a cable. The pumping unit is usually disposed within the well bore just above where perforations are made into a hydrocarbon producing zone.

Centrifugal submersible pumps typically employ a stack of rotatable impellers and stationary diffusers, where the impellers and diffusers alternate in the stack and are arranged coaxial with one another. Passages provided through both the impellers and diffusers define a flow path through which fluid is forced while being pressurized in the pump. Maximum pump efficiency generally occurs at a particular flow rate or along a range of flow rates, where the range is typically significantly less than the operating range of flow rates. Pumps are usually designed to operate at or close to a maximum efficiency. However, fluid flow rates through a pump may change, such as due to depletion of fluids in a reservoir, so that over time a pump may not be operating at its maximum efficiency.

SUMMARY OF INVENTION

The present disclosure describes example embodiments of a pump that is adjustable to operate at a best efficiency at varying rates of fluid flow. In an example embodiment the pump includes art impeller and a diffuser that is generally coaxial with the impeller. Passages are included in the impeller and the diffuser, where the passages define at least a portion of a flow path. Between the impeller and diffuser is an insert that has an annulus in fluid communication with the passages and is intersected by the flow path. Vanes are included that mount in the annulus, the vanes are adjustably positioned within the annulus, so that when a position of the vanes is adjusted, an area of the flow path in the annulus is varied. Optionally, the vanes are elongate members that pivot about a line substantially transverse to the annulus. In an alternate embodiment, the vanes are elongate members that pivot about a line substantially aligned with travel of the annulus. A motor may optionally be coupled with the vanes that is used for adjustably positioning the vanes. The insert can further include an annular hub, where the hub has an inner radius circumscribing an outer radius of a portion of the impeller, and an outer radius that defines an inner radial-surface of the annulus. The insert may also include a shroud having an inner radius that defines an outer radial surface of the annulus and having a lower end in contact with an upper end of a lower diffuser and an upper end in contact with a lower end of an upper diffuser. In an example, adjusting the area of the flow path in the annulus changes a flow rate at which the pump operates at a maximum efficiency. Optionally, the passages are spaced apart from one another at angular locations around an axis of the pump; the spaced apart passages can define multiple flow paths through the pump, that are also spaced apart at angular locations around the axis of the pump. In this example an adjustable vane is provided in each of the flow paths.

Also included herein is method of pumping fluid. In an example embodiment the method includes providing a pump having an impeller, a diffuser coaxial to and adjacent the impeller, and passages in the impeller and the diffuser that are in fluid communication. The method includes rotating the impeller to urge fluid through the passages and along a flow path in the pump. The pump can be operated at a maximum efficiency by adjusting an area of the flow path in a space between the impeller and the diffuser. In one example, adjusting the area of the flow path includes providing adjustable vanes in the flow path between the impeller and the diffuser, and pivoting the vanes. Alternatively, the flow rate of fluid through the pump can be monitored, and the area of the flow path can be reduced when the flow rate decreases. In an optional embodiment, the flow rate of fluid through the pump is monitored and increased when the flow rate increases. The impeller and diffuser can each have multiple passages to define multiple flow paths. In this alternate embodiment, the area of each flow path in the space between the impeller and the diffuser can be adjusted to operate the pump at its maximum efficiency.

The present disclosure also includes a pumping system. In one example embodiment the pumping system includes an electrical submersible pump (ESP) that is made up of an impeller and a diffuser that are coaxial and adjacent one another. Passages are included-that are formed axially through the impeller aid diffuser and an insert is set between the impeller and diffuses. The insert has an annular space that is in fluid communication with the passages. The annular space and passages define a flow path through the ESP. Also included with this embodiment is a vane in the annular space, where the vane is selectively pivotable into orientations to define a restriction in the flow path. The system further includes production tubing attached to the ESP. The system can optionally further include a motor operatively coupled to the vanes for orienting the vanes. In an example, adjusting the vanes regulates flow through the ESP and varies a value of a flow rate of maximum efficiency of the pump. Adjusting the vanes can regulate flow through the ESP and may vary a range of operating flow rates of the pump. In an example embodiment, the insert further includes an annular hub with an inner radius that circumscribes an outer radius of a portion of the impeller. The hub also has an outer radius that defines an inner radial surface of the annul us. A shroud is included with this embodiment that has an inner radius defining an outer radial surface of the annulus. The shroud has a lower end in contact with an upper end of a lower diffuser and an upper end in contact with a lower end of an upper diffuser. The passages of this example are spaced apart from one another at angular locations around an axis of the pump to define multiple Sow paths through the pump spaced apart at angular locations around the axis of the pump and wherein an adjustable vane is provided in each of the flow paths.

BRIEF DESCRIPTION OF DRAWINGS

Some of the features and benefits of the present invention having been stated, others will become apparent as the description proceeds when taken in conjunction with the accompanying drawings, in which.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Figure 1:
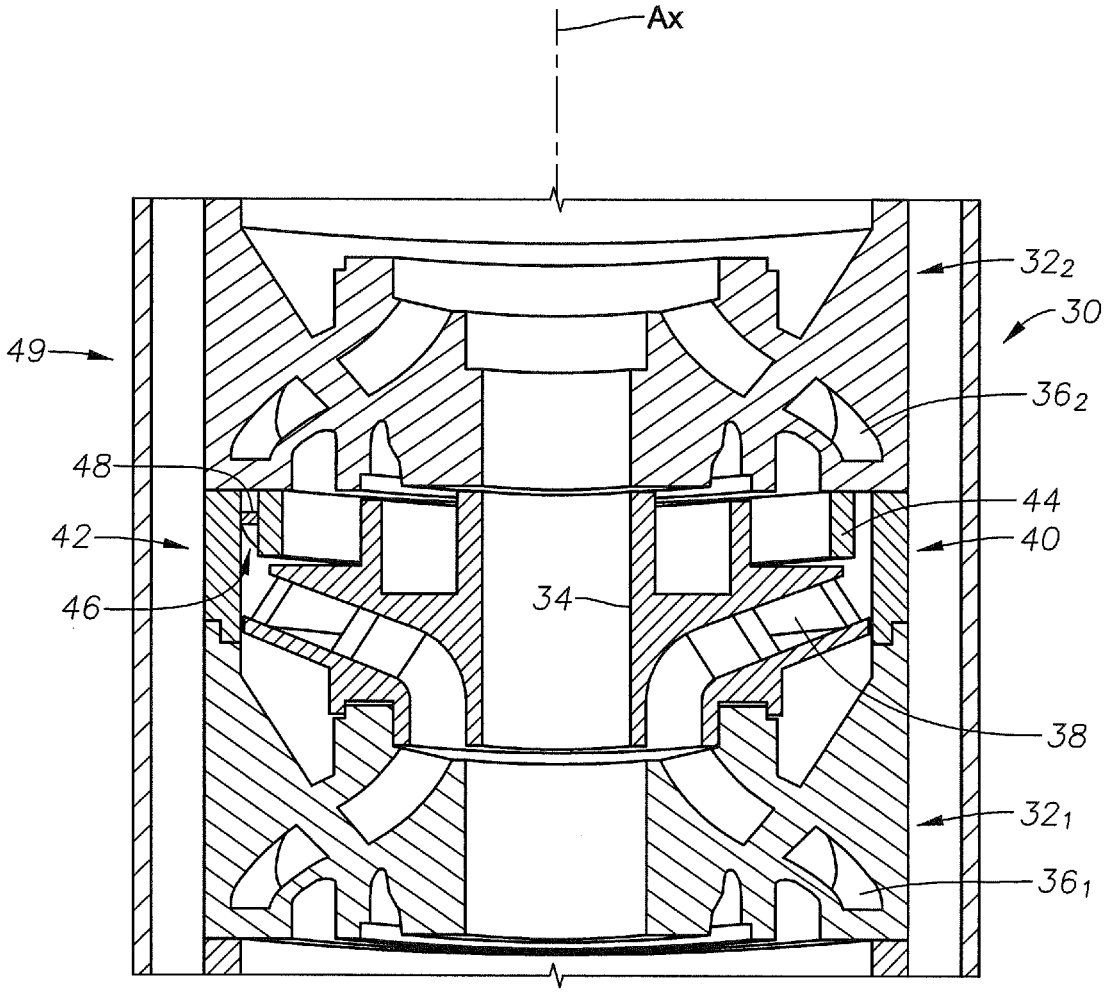
FIG. 1 is a side sectional view of a portion of a pump in accordance with the present disclosure.

An example embodiment of a portion of a pump 30 in accordance with the present disclosure is shown in a side sectional view in FIG. 1. The portion of the pump 30 is shown having a lower diffuser $\mathbf{32}_1$ and upper diffuser $\mathbf{32}_2$ separated by an impeller 34. A passage $\mathbf{36}_1$ is shown formed through the body of the lower diffuser $\mathbf{32}_1$ that follows a path curves generally upwardsthrough the lower diffuser $\mathbf{32}_1$ while extending radially inwards towards an axis $A_x$ of the pump30. The passage $\mathbf{36}_1$ has an upper end that is in fluid communication with a corresponding passage 38 formed within the impeller 34. Passage 38 also follows a curved path upward within the impeller 34; but instead of extending radially inward like passage $\mathbf{36}_1$, passage 38 projects radially outward with distance away from the lower diffuser $\mathbf{32}_1$. As is known, operating the pump urges fluid (not shown) upward through passage $\mathbf{36}_1$ and into passage 38. Rotating the impeller 34 discharges fluid from the passage 38 where it enters passage $\mathbf{36}_2$; shown formed through the upper diffuser $\mathbf{32}_2$ and mirroring the path of the passage $\mathbf{36}_1$ in the lower diffuser $\mathbf{32}_1$.

In the example of FIG. 1 though, a disk like insert 40 is provided between the impeller 38 and upper diffuser $\mathbf{32}_2$ that selectively adjusts a cross sectional area of the flow path that courses through the pump 30. More specifically, the insert 40 is shown having an outer annular shroud 42 whose outer surface has a radius that is substantially the same as a radius of the outer surfaces of the upper and lower diffusers $\mathbf{32}_1$, $\mathbf{32}_2$. The insert 40 is shown further including an annular hub 44 with an outer radius spaced radially inward from an inner radius of the shroud 42. Further in the example of FIG. 1, the axial height of the hub 44 is less than the axial height of the shroud 42. Shroud 42 has a lower end that contacts an upper end of the lower diffuser $\mathbf{32}_1$ that is roughly the same axial distance along the pump 30 as where the passage 38 exits the impeller 34. The upper end of the shroud 42 extends into contact with a lower end of the upper diffuser $\mathbf{32}_2$. In contrast, the hub 44 has a lower end that is spaced upward from or axially past, and. radially inward from, where the passage 38 exits the impeller 34. The radial spacing between the shroud 42 and hub 44 defines an annulus 46 between these two members. A first portion of the annulus 46 is in fluid communication with passage 38; and a second portion of the annulus 46, distal from the first portion, is also in fluid communication with passage $\mathbf{36}_2$. The fluid being pressurized by the pump 30 follows a flow path defined by interconnectivity of the passages $\mathbf{36}_1$, $\mathbf{36}_2$, 38 and annulus 46. Fluid exiting the passage 38 flows through the annulus 46 and upward into the passage $\mathbf{36}_2$; A seal (not shown) may be included between the hub 44 and upper end of the impeller 34 to prevent fluid exiting the passage 38 then making its way to the inner circumference of the hub 44.

Figure 2A:
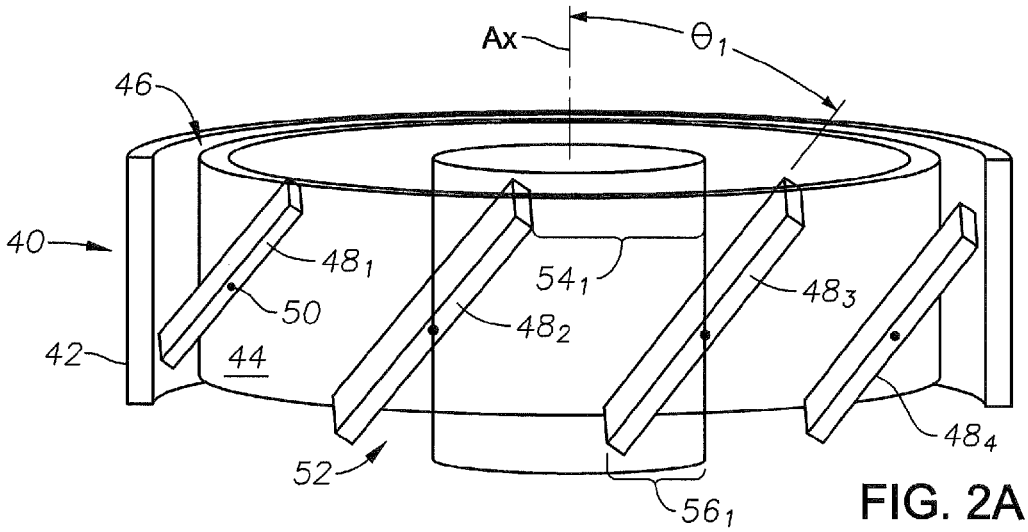
FIGS. 2A-2C are perspective side partial sectional views of a pump insert with adjustable vanes at varying pitch angles in accordance with the present disclosure.
Figure 2B:
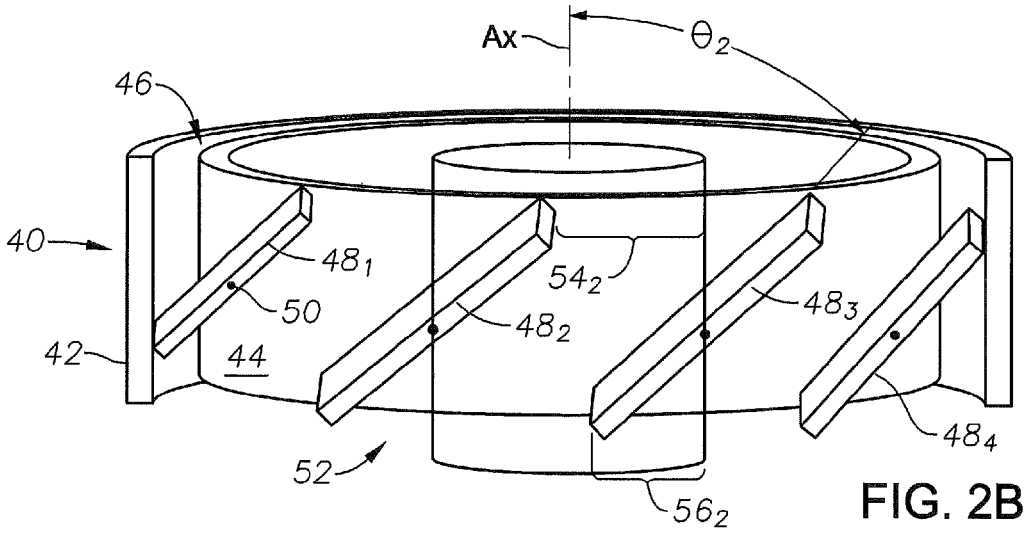
Figure 2C:
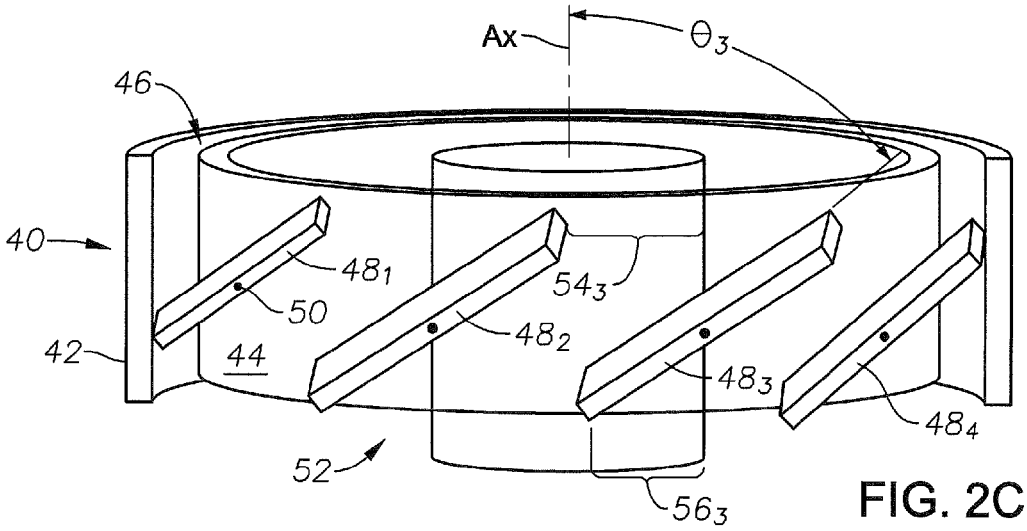

A vane 48 is shown set within the annulus 46 that in one example is a generally elongate member selectively positioned into different orientations within the annulus 46. The pump 30 is shown inserted within a tubular 49, where the tubular 49 can be a wellbore tubular and the pump 30 can be an electrical submersible pump. Optionally, the tubular 49 can be a transfer line, such as a caisson, for transmitting fluid to another location. Additional details of the vane 48 are illustrated in the side partial sectional views of FIGS. 2A through 2C. Referring now to FIG. 2A, a series of vanes $\mathbf{48}_1$-$\mathbf{48}_4$ are shown pivotingly attached to an outer radial surface of the hub 44. While a total of four vanes are shown in FIGS. 3A through 3C, for the purposes of discussion herein additional vanes may be included within the annulus 46 and spaced at various angular locations along the circumference of the annulus 46. In an example embodiment, the vanes $\mathbf{48}_1$-$\mathbf{48}_4$ are pivotingly attached by pins 50 shown extending through the body of the vanes $\mathbf{48}_1$-$\mathbf{48}_4$ and into the hub 44. As such, and as shown in the example sequence of FIGS. 2A through 2C, the vanes $\mathbf{48}_1$-$\mathbf{48}_4$ can be adjusted to pivot about pin 50 at an angle with respect to the axis $A_X$ thereby affecting the sectional area of the flow path through the pump 30; and thus the flow rate of fluid across the insert 40. For the purposes of illustration in FIGS. 2A through 2C a flow path portion 52 is shown extending through the annulus 46 that schematically represents a flow channel for fluid passing from the impeller 38 (FIG. 1) below the insert 40, across the insert 40 through the annulus 46, and to the diffuser $\mathbf{32}_2$ above the insert 40. In the example of FIGS. 2A through 2C, adjacent vanes define boundaries of the flow path portion 52 at spaced apart angles with respect to the axis $A_x$. Alternate example embodiments exist wherein the vane flow path portion 52 may include one or more vanes in the space of the flow path portion 52.

In FIG. 2A the vanes $\mathbf{48}_1$-$\mathbf{48}_4$ are pivoted at an angle $\theta_1$. In this configuration the vane $\mathbf{48}_2$ reduces the available area through the flow path, portion 52 by restricting passage exit $\mathbf{54}_1$ at the upper end of the flow path portion 52. Pivoting vane $\mathbf{48}_3$ extends it into the flow path portion 52; where the amount of restriction is defined by an inlet restriction $\mathbf{56}_1$. In contrast, in one example when vanes $\mathbf{48}_1$-$\mathbf{48}_4$ are substantially aligned with axis $A_x$, passage exit $\mathbf{54}_1$ has a cross sectional area substantially the same as that of the inlet to the passage $\mathbf{36}_2$, and the inlet to the flow path portion 52 has a cross sectional area substantially the same as that of the exit of the passage 36.

The depiction in FIG. 2B illustrates operation where the vanes $\mathbf{48}_1$-$\mathbf{48}_4$ have been adjusted to tilt at an angle $\theta_2$ with respect to the axis $A_x$, wherein angle $\theta_2$ is greater than angle $\theta_1$. As such, the passage exit $\mathbf{54}_2$ at the upper end of the flow path portion 52 is reduced in FIG. 2B over that of the passage exit $\mathbf{54}_1$ of FIG. 2A. Similarl, the inlet restriction $\mathbf{56}_2$ shown on the lower end of the flow path portion 51 aid defined by the intersection of the vane $\mathbf{48}_3$ into the flow path portion 52 is increased in size over that of the inlet restriction $\mathbf{56}_1$ from FIG. 2A. It necessarily follows that fluid flow across the insert 40 of FIG. 2B is less than fluid flow across the insert 40 of FIG. 3A. FIG. 2C illustrates another variation wherein the vanes $\mathbf{48}_1$-$\mathbf{48}_4$ are tilted at an angle $\theta_3$ with respect to the axis Ax wherein angle $\theta_3$ exceeds angle $\theta_2$. This example provides an illustration of yet further restriction of the flow of fluid through the flow path portion 52. Thus, the passage exit $\mathbf{54}_3$ in FIG. 2C is smaller than passage exit $\mathbf{54}_2$ in FIG. 2B and inlet restriction 563 of FIG. 2C is greater than inlet restriction $\mathbf{56}_2$ of FIG. 28.

Figure 3:
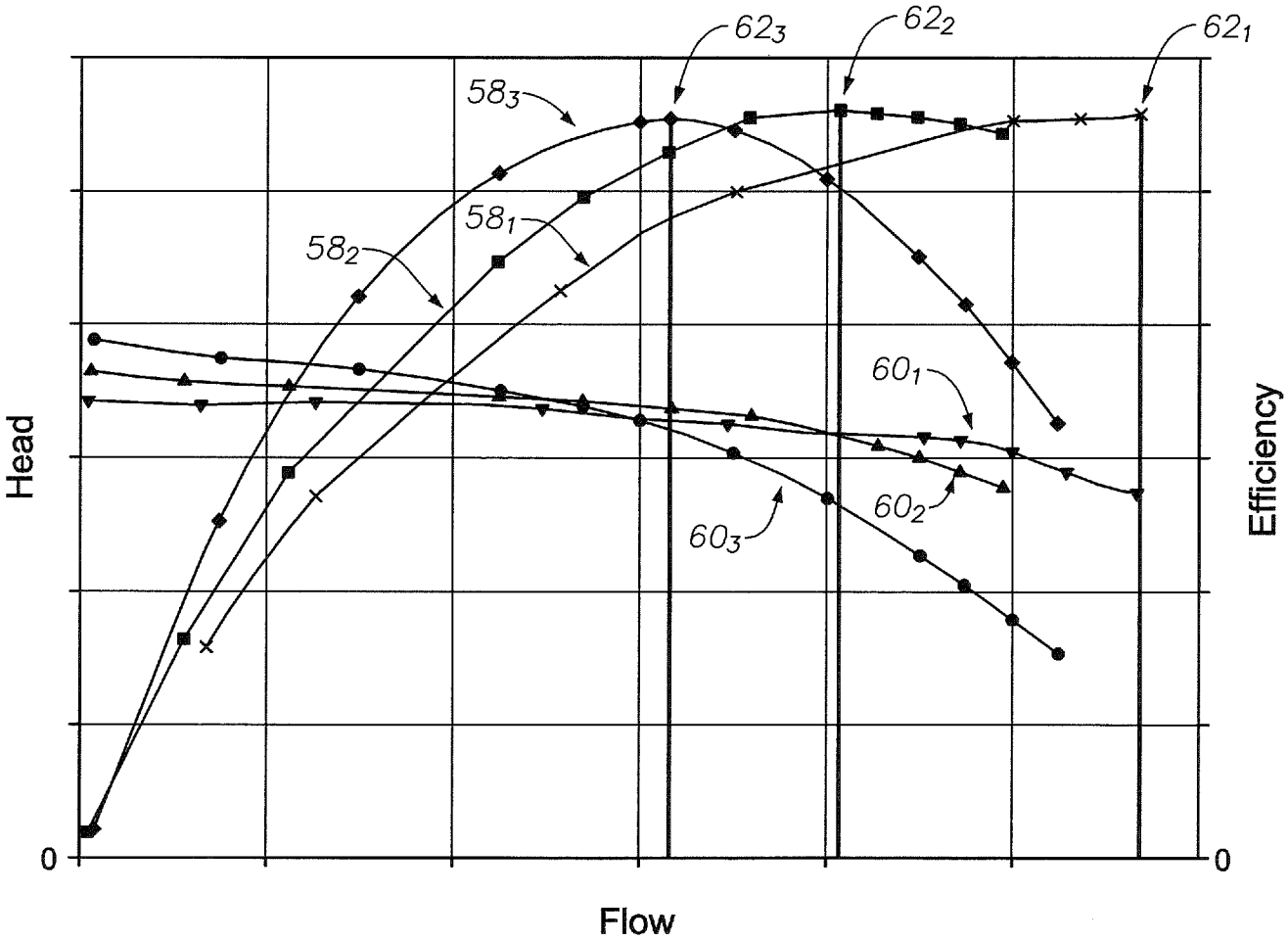
FIG. 3 is a plot of pump head and pump efficiency curves.

Pump efficiency can be affected by the cross sectional area of the flow path, including the cross sectional area of the portion of the flow path between the impeller and diffuser. As such, selectively regulating the area of the flow path through the pump 30, such as within the area between an impeller and diffuser, can allow for operating adjustments so the pump can operate at a maximum efficiency. Referring now to FIG. 3, a plot is provided that contains curves for pump efficiency and pump head, which in an example are representative of an ESP. A series of pump efficiency curves $\mathbf{58}_1$, $\mathbf{58}_2$, $\mathbf{58}_3$ are shown that in one example embodiment illustrate pump head performance realized by adjusting the vanes $\mathbf{48}_1$-$\mathbf{48}_4$ as illustrated in FIGS. 2A through 2C. For example, as pump efficiency curve $\mathbf{58}_1$ is shown having a maximum efficiency at a flow rate greater than pump efficiency curves $\mathbf{58}_2$ or $\mathbf{58}_3$, pump efficiency curve $\mathbf{58}_1$ is correlates to the configuration of Figure 2A, i.e. the configuration providing the most flow. Similarly, pump efficiency curve $\mathbf{58}_2$ correlates to the configuration of FIG. 2B, and pump efficiency curve $\mathbf{58}_3$ correlates to the configuration of FIG. 2C.

The pump head curves $\mathbf{60}_1$, $\mathbf{60}_2$, $\mathbf{60}_3$, also correlate to the cross sectional area of the flow path portion 52 and how it is controlled by selective positioning of the vanes $\mathbf{48}_1$-$\mathbf{48}_4$. As shown, pump head curve $\mathbf{60}_1$ generally yields an increased pump head with increased Sow rate and thus can be shown to correspond to the configuration of the pump in FIG. 2A. In descending order, the pump head curves $\mathbf{60}_2$, $\mathbf{60}_3$ also correspond to the configuration of the pumps in FIG. 2B and FIG. 2C respectively. As such, by monitoring the flow and flow rate of the fluid through the pump 30 the vanes can be adjusted to affect the flow rate of fluid through the flow path portion 52, thereby regulating flow and flow rate through the pump 30, and providing the ability to operate the pump 38 at a maximum efficiency, Further identified in the plot of FIG. 3 are maximum efficiency points $\mathbf{62}_1$, $\mathbf{62}_2$, $\mathbf{62}_3$ that illustrate where on the pump efficiency curves $\mathbf{58}_1$, $\mathbf{58}_2$, $\mathbf{58}_3$ the maximum efficiency of the pump is realized and at which corresponding flow rate. As discussed above, regulating and/or controlling flow and flow rate of pumped fluid that flows from an impeller to an adjacent diffuser, provides an ability to operate the pomp at a maximum efficiency irrespective of the particular flow through the pump. In one example of operation, the flow and flow rate through, the pump is monitored and if the current configuration of the pump has a best operating efficiency at a flow rate different from the monitored flow rate, the vanes can be adjusted while pumping to be at maximum efficiency at or close to the actual flow rate. Fluid flow monitoring can occur at an entrance to the pump or at a terminal point where fluid exits the pump or production tubing.

Figure 4:
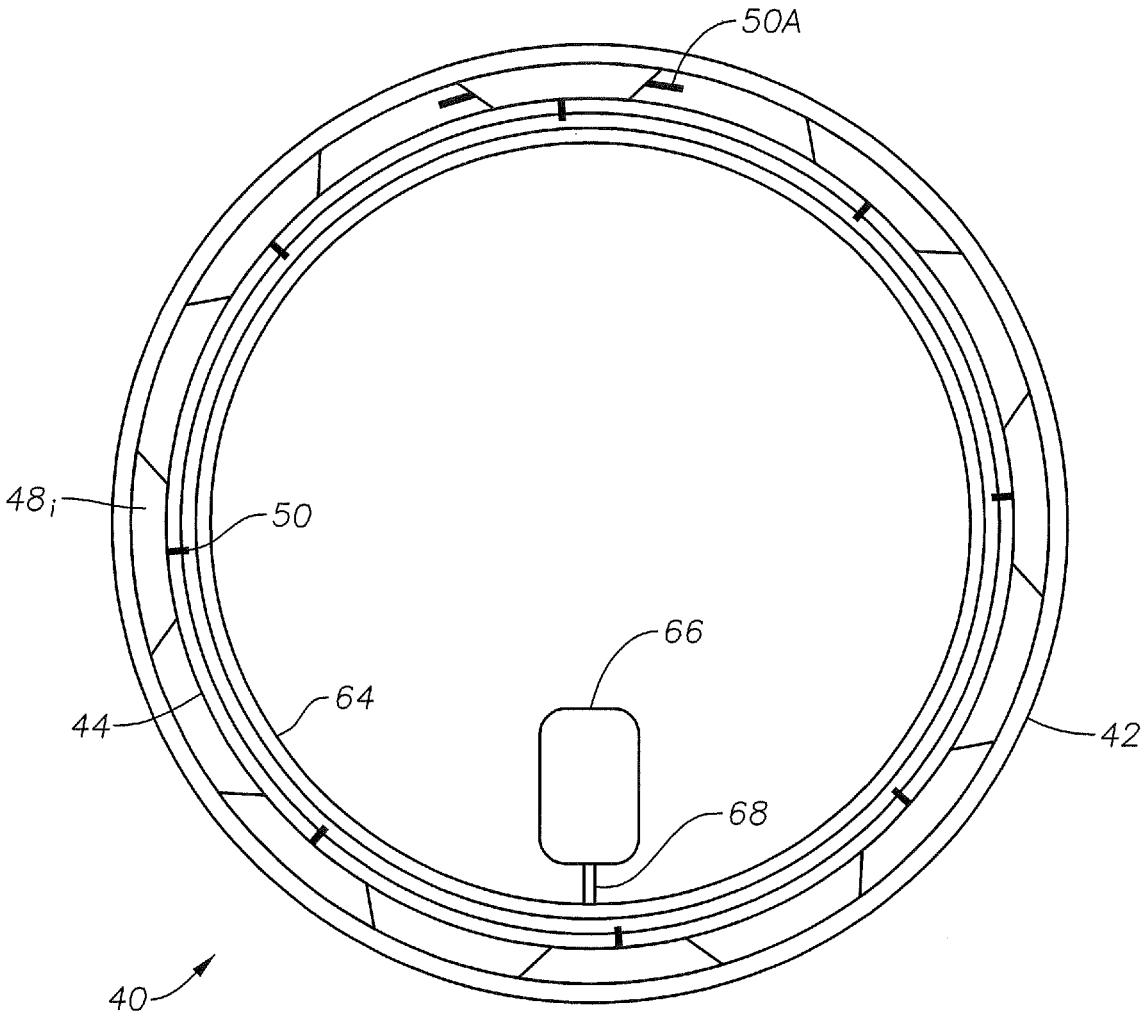
FIG. 4 is a sectional plan view of a portion of an alternate embodiment of a pump insert coupled with a motor.

A plan sectional view of an example embodiment of an insert 40 is shown in FIG. 4 and depicting an example means for pivoting the vanes $\mathbf{48}_i$. A circular drive ring 64 is shown that may engage gears (not shown) disposed on the pins 50 that mount in each of the vanes $\mathbf{48}_i$. The ring 64 may be powered by a motor 66 and coupled to the motor 66 via a drive shaft 68. Motor 66 may he disposed within the insert 40, or cavities (not shown) may be formed inside an adjacent diffuser 32 (FIG. 1) for housing the motor 66. Optionally, pin 50A may extend longitudinally through the vanes $\mathbf{48}_i$ so that the vanes $\mathbf{48}_i$ can he pivoted about their elongate axis.

Figure 5:
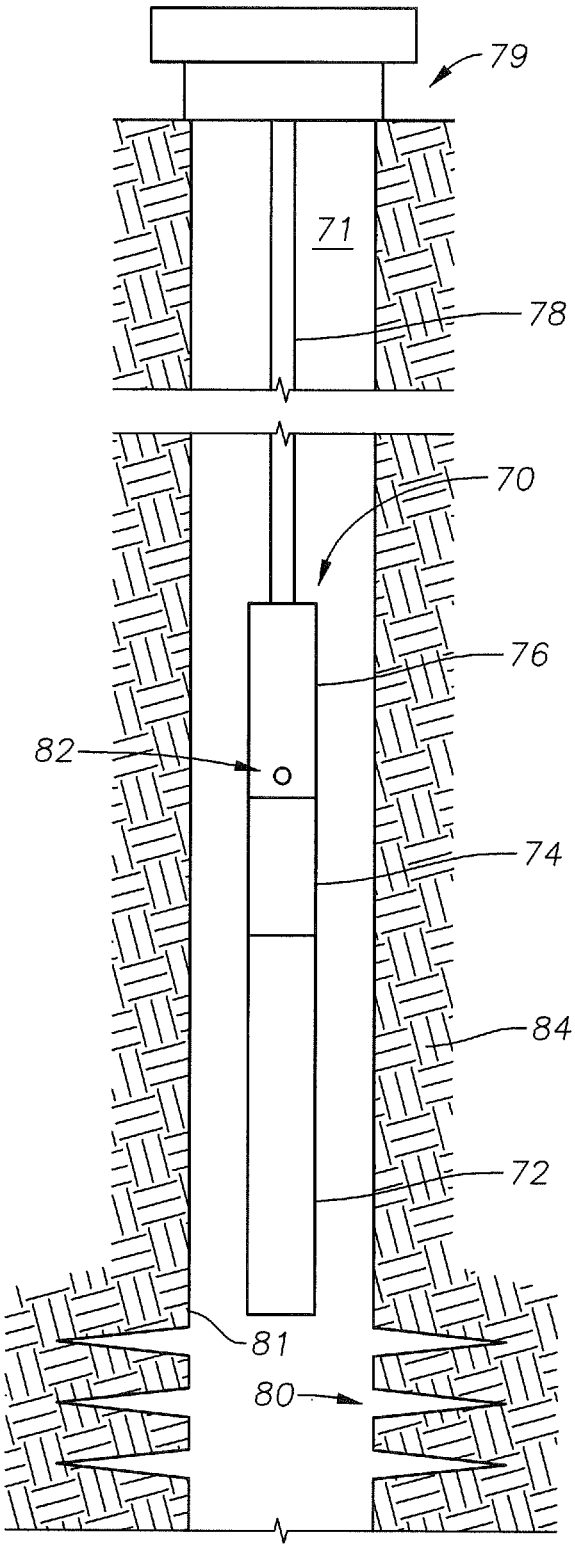
FIG. 5 is a partial sectional view of an example of a pumping system having the pump of FIG. 1 in accordance with the present disclosure.

With reference now to FIG. 5, shown in a partial sectional view is an example of an ESP system 70 disposed in a well bore 71 tor pumping fluids from the wellbore 71. The ESP system 70 is made up of a motor 72, a seal section 74, and pump 76. Where the pump 76 is substantially the same as pump 30 of FIG. 1. Production tubing 78 on the discharge end of the pump 76 provides a conduit tor delivering the fluid pressurized by the pump 30 to a wellhead assembly 79 on surface above the wellbore 71. Seal section 74 reduces a pressure differential between wellbore fluid and lubricant in motor 72. Energizing the motor 72 drives a shaft (not shown) coupled between the motor 72 and the pump 76. The source of the fluid drawn into the pump comprises perforations 80 formed through a casing 81 that lines the wellbore 70. The fluid is represented by arrows extending from the perforations 80 to an inlet 82 on the pump 76. The perforations 80 extend into a surrounding hydrocarbon producing formation 84. Thus the fluid flows from the formation 84, past the motor 72 on its way to the inlet 82.

It is to be understood that the invention is not limited to the exact details of construction, operation, exact materials, or embodiments shown and described, as modifications and equivalents will be apparent to one skilled in the art. For example, pump 30, 76 is not limited to a single insert 40 therein, but instead can optionally include inserts 40 strategically positioned therein, an insert 40 between each adjacent diffuser 32 and impeller 34, or an insert 40 between a discharge of an impeller 34 and inlet to a diffuser 32. In the drawings and specification, there have been disclosed illustrative embodiments of the invention and, although specific terms are employed, they are used in a generic and descriptive sense only and not for the purpose of limitation.

The invention claimed is:

1. A submersible pump comprising:

an impeller;

a diffuser generally coaxial with the impeller;

passages in the impeller and diffuser that define a flow path;

an insert between the impeller and diffuser comprising, an annulus in fluid communication with the passages and that is intersected by the flow path, and vanes mounted in the annulus that are adjustably positioned within the annulus, so that when a position of the vanes is adjusted, an area of the flow path in the annulus is varied; and wherein the insert further comprises an annular hub having an inner radius that circumscribes an outer radius of a portion of the impeller and an outer radius that defines an inner radial surface of the annulus.

2. The pump of claim 1, wherein the vanes are elongate members, each of which pivots about a pivot point located on a line substantially transverse to an elongate axis of one of the vanes.

3. The pump of claim 1, wherein the vanes are elongate members, each of which pivots about elongate axis of one of the vanes.

4. The pump of claim 1, further comprising a motor coupled with the vanes and for adjustably positioning the vanes.

5. The pump of claim 1, wherein the insert further comprises a shroud having an inner radius that defines an outer radial surface of the annulus and having a lower end in contact with an upper end of a lower diffuser and an upper end in contact with a lower end of an upper diffuser.

6. The pump of claim 1, wherein adjusting the area of the flow path in the annulus changes a flow rate at which the pump operates at a maximum efficiency.

7. The pump of claim 1, wherein the passages are spaced apart from one another at angular locations around an axis of the pump to define multiple flow paths through the pump at spaced apart at angular locations around the axis of the pump and wherein one of the vanes is provided in each of the flow paths.

8. A method of pumping fluid comprising:

providing a pump having an impeller, a diffuser coaxial to and adjacent the impeller, passages in the impeller and the diffuser that are in fluid communication;

mounting an insert member between an impeller outlet of the impeller and a diffuser inlet of the diffuser, the insert member having a coaxial annular hub surrounded by an annular space that is located axially between the impeller outlet and the diffuser inlet;

mounting a plurality of pivotal vanes above the impeller outlet and below the diffuser inlet in the annular space, defining flow paths between the impeller outlet and the diffuser inlet;

rotating the impeller to urge fluid through the passages and through the flow paths in the annular space; and pivoting the vanes to adjust flow areas of the flow paths.

9. The method of claim 8, wherein the step of adjusting an area of the mounting the pivotal vanes comprises pivotally mounting the vanes to the hub.

10. The method of claim 8, further comprising monitoring the flow rate of fluid through the pump and pivoting the vanes to reduce the areas of the flow paths when the flow rate decreases.

11. The method of claim 8, further comprising monitoring the flow rate of fluid through the pump and pivoting the vanes to increase the areas of the flow paths when the flow rate increases.

12. The method of claim 8, further comprising mounting an annular shroud concentrically around the hub and below the diffuser inlet, the shroud defining an outer perimeter of the annular space.

13. A pumping system comprising:

an electrical submersible pump (ESP) having an axis and comprising:

a lower diffuser having an annular lower diffuser outer wall and a lower diffuser outlet;

an upper diffuser having an annular upper diffuser outer wall and an upper diffuser inlet;

an impeller having impeller passages and an impeller inlet leading upward and outward to an impeller outlet, the impeller inlet being in registry with the lower diffuser outlet and the impeller outlet being spaced axially below the upper diffuser inlet;

an insert member between the upper and lower diffusers and surrounding at least a portion of the impeller, the insert member having an annular shroud having a lower end in engagement with an upper end of the lower diffuser outer wall and an upper end in engagement with a lower end of the upper diffuser outer wall, the insert member shroud defining an outer perimeter of an annular space between the impeller outlet and the upper diffuser inlet; and at least one vane in the annular space above the impeller outlet and below the upper diffuser inlet and selectively pivotable into orientations to define a restriction in a flow path through the annular space.

14. The system of claim 13, further comprising a motor operatively coupled to the sat least one vane for orienting the vane.

15. The system of claim 13, wherein the insert member further comprises an annular hub concentrically located within the shroud, the annular hub defining an inner perimeter of the annular space.

16. The system of claim 15, wherein the at least one vane is pivotally mounted to the hub.

17. The system of claim 15, wherein the hub has an upper end in engagement with the lower end of the upper diffuser.

* * * * *

UNITED STATES PATENT AND TRADEMARK OFFICE

CERTIFICATE OF CORRECTION

PATENT NO. : 9,206,677 B2
APPLICATION NO. : 13/586417
DATED : December 8, 2015
INVENTOR(S) : Baojun Song et al.

It is certified that error appears in the above-identified patent and that said Letters Patent is hereby corrected as shown below:

In The Specification
Column 3, line 45, insert --that-- before curves
Column 5, line 6, delete "Similarl" and insert --Similarly--
Column 5, line 7, delete "aid" and insert --and--
Column 5, line 35, delete "is"
Column 5, line 44, delete "Sow" and insert --flow--
Column 5, line 63, delete the (",") after "through"
Column 6, line 20, delete "tor" and insert --for--

Signed and Sealed this
First Day of March, 2016

Michelle K. Lee

Michelle K. Lee
*Director of the United States Patent and Trademark Office*